US011767161B2

(12) United States Patent
Alspach

(10) Patent No.: US 11,767,161 B2
(45) Date of Patent: Sep. 26, 2023

(54) ADJUSTABLE LIFT BAR SYSTEM

(71) Applicant: Nick Alspach, Alexandria, IN (US)

(72) Inventor: Nick Alspach, Alexandria, IN (US)

( * ) Notice: Subject to any disclaimer, the term of this patent is extended or adjusted under 35 U.S.C. 154(b) by 454 days.

(21) Appl. No.: 17/176,826

(22) Filed: Feb. 16, 2021

(65) Prior Publication Data

US 2021/0253341 A1 Aug. 19, 2021

Related U.S. Application Data

(60) Provisional application No. 62/977,463, filed on Feb. 17, 2020.

(51) Int. Cl.
*B65D 88/12* (2006.01)
*B65D 90/00* (2006.01)

(52) U.S. Cl.
CPC ..... *B65D 90/0033* (2013.01); *B65D 88/123* (2013.01)

(58) Field of Classification Search
CPC ..... B60P 1/6418; B60P 1/6427; B60P 1/6436; B60P 1/6454; B60P 1/6463; B60P 1/6472; B60P 1/6481; B60P 1/649; B60P 7/13; B60P 7/132; B65D 88/123; B65D 90/0006; B65D 90/0013; B65D 90/002; B65D 90/0033; B66C 1/663
USPC ..... 211/85.8
See application file for complete search history.

(56) References Cited

U.S. PATENT DOCUMENTS

| | | | |
|---|---|---|---|
| 3,971,846 | A | 7/1976 | Carlsson |
| 3,987,918 | A | 10/1976 | Corompt |
| 5,725,348 | A | 3/1998 | Drake |
| 7,883,310 | B2 | 2/2011 | McGraw |
| 8,465,246 | B2 | 6/2013 | Duell et al. |
| 9,227,546 | B2 | 1/2016 | Marmur et al. |
| 10,131,264 | B2 | 11/2018 | Sailer |
| 10,377,292 | B2 | 8/2019 | Downing et al. |
| 2007/0237617 | A1 | 10/2007 | Schroeder |

*Primary Examiner* — Joshua E Rodden
(74) *Attorney, Agent, or Firm* — Ritchison Law Offices, PC; John D Ritchison

(57) ABSTRACT

An Adjustable Lift Bar System for roll off containers and other applications used to enable a roll off to be compatible with a lift bar hoist system set at various heights; the system includes a lift bar having a crown; a pair of lift bar flanges and mounting flanges with a set of holes to receive removable fasteners and mounting flanges; a long spreader tube between the mounting flanges; a pair of short spreader tubes, bolt plates with a series of holes, the pair of vertical supports, and fasteners to adjustably secure the pair of the mounting flanges of the lift bar assembly to the pair of the bolt plates.

19 Claims, 10 Drawing Sheets

95
50
65
95
33

44
52
50
44

90

33
44
70,44A
95
50
90

44
44A
40A
41
40

44
47
49
65
49
50
49
92
60

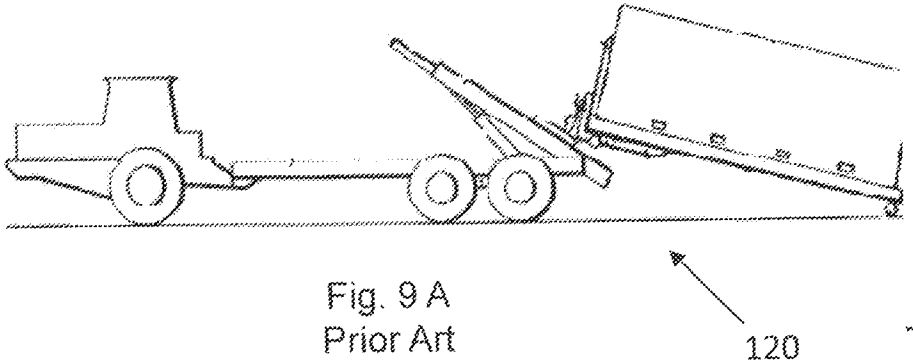
Fig. 9 A
Prior Art
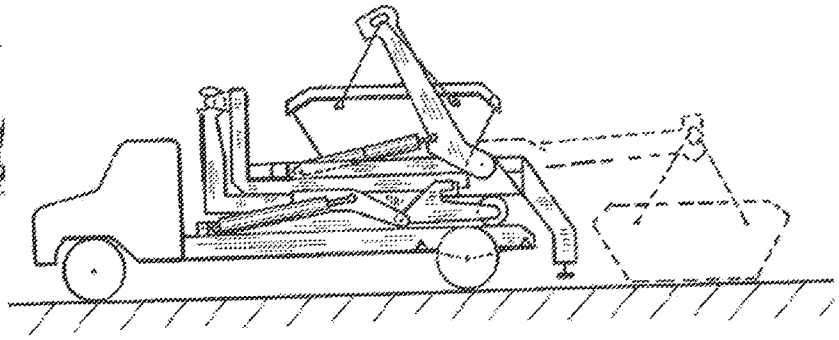
Fig. 9 B
Prior Art
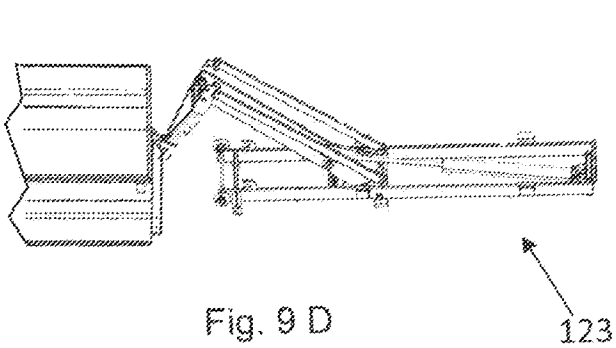
Fig. 9 C
Prior Art
Fig. 9 D
Prior Art
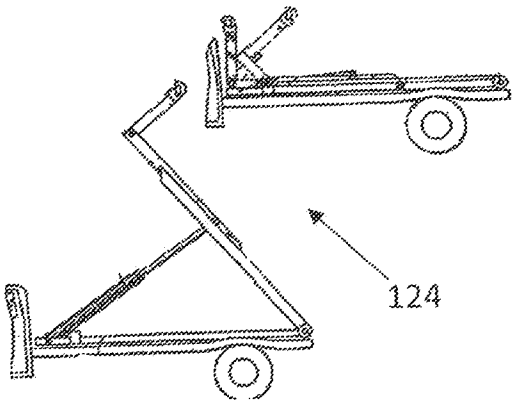
Fig. 9 E
Prior Art

ADJUSTABLE LIFT BAR SYSTEM

CROSS-REFERENCE TO RELATED APPLICATIONS

This application claims the benefit of United States Provisional patent application with Ser. No. 62/977,463 filed Feb. 17, 2020, by Nick Alspach of Steel-Mart. The application was entitled "Adjustable Lift Bar System".

FIELD OF INVENTION

This invention relates to an Adjustable Lift Bar System. It is an improvement to a roll off system which is an apparatus for handling, loading, unloading, and transporting containers, load supporting bodies, pallets and like bulky and heavy objects. The Adjustable Lift Bar System is available for new or refurbished devices that provide a dumpster and lifting arm of the type for lifting the dumpster and dumping the contents of the dumpster into a storage box or, in the waste disposal industry, for disposal of waste material to a landfill or farm field.

The present invention deals with the field of vehicles designed for the purpose of transporting containers such as refuse containers which includes a hook lift jib apparatus along with a powered cylinder member for the purpose of placement and removal of such a container relative to a position of rest upon the rear of the vehicle such as a transport truck or the like. The improvement—an Adjustable Lift Bar System—permits the ability to use one roll off container with truck and arm systems of various sizes. This can be original equipment or refurbished units that allow for the various sized trucks and roll off containers to be used together as well as switched to other trucks in the future. This invention offers a uniquely universal construction because it can be used for handling and transporting containers of various sizes and configurations while maintaining the same hook lift jib apparatus and the same powering system.

FEDERALLY SPONSORED RESEARCH

None.

SEQUENCE LISTING OR PROGRAM

None.

BACKGROUND

Field of Invention and Prior Art

As far as known, there are no Adjustable Lift Bar System or the like. It is believed that this product is unique in its design and technologies.

Background

Containers and detachable load supporting bodies with or without walls are utilized to an ever-increasing extent because of the advantages gained by unit-loading. For example, the waste management field has been standardized regarding commercial waste disposal containers. The two most common types of containers are the roll-off container and the front-load container. The roll-off container is larger and typically used for large volumes of waste, such as construction debris, commercial and industrial refuse, bulk items, and the like. The front-load container is smaller and typically used for garbage, restaurant waste, packing materials, retail waste, and other refuse. The industry has also specialized regarding the type of vehicle used to transport these waste disposal containers. A roll-off truck is specially designed to transport roll-off containers between the site where they are filled and a disposal site, and a front-load container truck is specially designed to transport front-load containers between the site where they are filled and a disposal site.

A roll-off truck has a tilting, flat bed and a hoisting mechanism, usually involving a winch and cable but alternatively involving a hydraulic arm, which is used to engage a roll-off container, or some other similar device. The bed incorporates rollers to facilitate the movement of a roll-off container over its surface. The rollers are recessed below the surface of the bed and are designed to accommodate wheels or rails located on the underside of roll-off containers. A roll-off container is typically constructed of a rigid metal material to standardized dimensions in a substantially rectangular configuration, formed of a bottom floor and four upwardly depending side walls and an open top, with a front to back length exceeding the side to side width. The roll-off container is designed with wheels or parallel rails on the underside of the bottom floor suitable for cooperative rolling engagement with the rollers on the beds of roll-off trucks. Roll-off containers are further designed with standard sized attachment fittings affixed to their front walls enabling them to be engaged by the hoisting mechanism of the roll-off truck. These attachment fittings are typically a hook or prong, over which a looped end of a cable may be placed, or a bar engageable by a hydraulic arm. Other attachment fitting designs are also used.

A problem associated with the handling and transporting of containers and detachable load supporting bodies is that strong lifting appliances must be available to permit transferring the containers between for instance railway cars, trucks or like transport vehicles. Likewise, the pick-up systems have traditionally been all-welded mechanisms that must be purchased as a specific height and size. Therefore, a roll off container is used and outfitted for a specific height and sized to the tractor and pick-up arm. The present invention has for its object to provide an apparatus which permits the roll off containers and hoppers to be adjustable for various truck sizes. This removable and adjustable system can then be used with various truck tractors and their pick-up arms with changing the levels with a wrench and a forklift. After coupling of the adjustable lift system at the preferred height on the roll off container, the container is ready to be loaded and unloaded by the tractor. If another height truck is encountered, the adjustable lift system can be adjusted higher or lower without the cost of removing weldments and re-welding. This the roll off container is much more versatile. As is evident from the foregoing descriptions, the specially designed trucks for transporting the different types of waste disposal containers are often incompatible with each other because of the different height pick-up points on the containers. This results in great expense and inefficiency of operation with a corresponding economic burden on waste management fleets.

Problem Solved

The improvement and problem solved as to roll off containers is an Adjustable Lift Bar System that may be easily changed to accommodate the various heights needed for the tractor and pick-up arms. This should be versatile enough that removing weldments and re-welding this metal structure is not necessary. By merely using simple tools and a lift the lift system of the roll off container can be quickly adjusted to differing heights.

PRIOR ART

As far as known, there are no Adjustable Lift Bar System or the like. It is believed that this product and system is unique in its design and technologies. A novelty search revealed:

A. U.S. Pat. No. 3,971,486 issued to Carlsson in 1976 for Apparatus for Handling and Transporting Containers, Load Supporting Bodies, pallets and the like. It teaches an apparatus for handling, loading, unloading and transporting containers, load supporting bodies, pallets and like bulky and heavy objects with the use of a transport vehicle and a fork lift type lifting device disposed on the transport vehicle. The fork lift device is pivoted to one end of the transport vehicle in such a way that the frame carrying the fork lift device can be pivoted between a vertical position and a position coplanar with the chassis of the transport vehicle. Coupling means associated with the fork lift device is designed so as to permit being coupled with mating coupling means associated with the end of a load supporting body which is usable as a transportation support for containers and like objects. When the load supporting body is coupled with the fork lift device, the body can be pulled onto and lowered from the transport vehicle under simultaneous pivotment of the frame of the fork lift device and shifting of the fork lift device along the frame thereof.

B. U.S. Pat. No. 3,987,918 issued to Corompt in 1976 for a Device for Loading or Unloading Boxes OR Removable Buckets, for Lorries. Here is taught a handling device, in particular for lorries intended for handling boxes or containers, comprising a chassis on which arms are pivoted, which arms are adapted to handle removable buckets. The device is adapted to be mounted on a lorry specially intended for handling boxes or containers, and provided with suitable hoist means, such as either a rocking derrick or a cable winch.

C. U.S. Pat. No. 5,725,348 issued to Drake in 1998 for a Dumpster and Vehicle Mounted Lifting Arm Therefor. This teaches a dumpster and a lifting arm for lifting the dumpster and dumping the contents of the dumpster into a storage box. The dumpster includes an open top and is for storing garbage or some other material and is supported on the ground. The articulated lifting arm is usually mounted beneath a vehicle or other transportation apparatus having an open topped storage box. The articulated lifting arm is arranged for lifting the dumpster from the supporting surface to a position above the storage box for dumping any material stored in the dumpster into the storage box. The articulated lifting arm comprises hydraulic devices, a base member, and arm member, first positioning means, an attachment member, lifting devices, and dumping/positioning devices.

D. U.S. Pat. No. 7,883,310 issued to McGraw in 2011 for a Roll-off Truck Bed Adapter for Use with Standard Front Load Containers. Shown is an adapter device to be used with a standard roll-off truck to allow said truck to lift and transport standard front-load containers; said adapter device comprising a rigid support structure adapted to engage with the bed of the roll-off truck; an engagement structure integrated with the support structure and adapted to be engaged by a hoist mechanism of the roll-off truck; and a lift structure integrated with the support structure and comprising a pair of parallel forks adapted to engage with the standard lift fittings of the front-load container.

E. U.S. Pat. No. 8,465,246 issued to Duell et al. in 2007 for a Roll-off Hoist with Hinged End Portion. Provided her is a container handling system and method for a wheeled transport vehicle is disclosed that is capable of loading and unloading containers, particularly in locations where the overhead height is limited. A hinged tail member at the rear end of the elongated body (a/k/a tilt frame member) is rotated to the ground allowing the containers to be loaded and unloaded without rotating the tilt frame to its maximum height. A cable reeving arrangement, such as a dual reeving arrangement, can be utilized to load and unload the container.

F. U.S. Pat. No. 9,227,546 issued to Marmur et al. in 2016 for a Hook Lift Jib Apparatus. This is an apparatus for a hook lift jib which is easily movable between an extended position and a retracted position to make the applications for use of this apparatus more universal since it is capable of being used for lifting and handling of refuse containers of various sizes. The jib member can be retained in the extended position by the placement of two locking pins extending therethrough or it can be capable of floating or automated self-movement between the extended and retracted position responsive to removal of one of the pin members. The hook lift jib apparatus is designed to be particularly useful handling containers of different sizes particularly useful with containers wherein the container grip bar is between 54 inches and 61 inches from the adjacent ground surface. Taught here is a hook lift mounted on heavy duty trucks or trailers that allows for lifting, re-positioning, transporting, and unloading various containers. A hook lift assembly having a frame. A lift arm having lift linkages rotatably mounted at a hinge end to at least one position on the frame. A hook arm rotatably coupled at a hook end of the lift arm. The hook arm configured for loading or unloading a container from the frame. A hydraulic actuator coupled at one end to the frame and at the other end to the lift linkage. The hydraulic actuator simultaneously lifting the lift linkage from a storage position into an extended position and adjusting an angle between the hook arm and the lift linkage.

G. U.S. Pat. No. 10,131,264 issued to Sailer in 2018 for a Hook lift Trailer. Shown and taught is a hook lift mounted on heavy duty trucks or trailers that allows for lifting, re-positioning, transporting, and unloading various containers. A hook lift assembly having a frame. A lift arm having lift linkages rotatably mounted at a hinge end to at least one position on the frame. A hook arm rotatably coupled at a hook end of the lift arm. The hook arm configured for loading or unloading a container from the frame. A hydraulic actuator coupled at one end to the frame and at the other end to the lift linkage. The hydraulic actuator simultaneously lifting the lift linkage from a storage position into an extended position and adjusting an angle between the hook arm and the lift linkage.

H. U.S. Pat. No. 10,377,292 issued to Downing et al. in 2019 for a Hoist Mechanism Locking Assembly. Provided here is a hoist mechanism having an improved locking assembly. A hoist mechanism includes a frame including a first end and a second end, and the frame is pivotably coupled with a mounting structure at the frame first end. The hoist mechanism also includes a hoist arm assembly pivotably coupled with the frame second end, and the hoist arm assembly includes a jib operative to move between an extended position and a retracted position. The locking assembly includes a lug disposed on the jib and a link arm coupled with the frame. The link arm defines a slot dimensioned to selectively engage with the lug when the jib is moved from the retracted position. The hoist arm assembly is pivotable with respect to the frame when the jib is in the retracted position, and the frame and the hoist arm assembly are pivotable together when the jib is in the extended position.

I. US Patent Application US2007/0237617 by Schroeder in 2007 for a Linkage for On-Off Loading and Dumping of a Body on a Truck Frame. This shows damage to a linkage in a truck loading mechanism including a tilt link, a secondary link and a dump link is avoided by providing interlocking tabs where one of the tabs is slidably and pivotally mounted to the dump link and normally held in an operative position by means of a spring that allows downward and inward movement of one of the interlocking tabs before damage can occur when excessive forces exist between the links.

As can be observed, none of the prior art has anticipated or caused one skilled in the art of roll-off carrying systems to see this invention by Alspach as obvious to a person skilled in the ordinary art of the industry. The Adjustable Lift Bar System provides an answer to the need for adjustable systems that can be on new roll-off containers or retrofitted to existing carriers.

SUMMARY OF THE INVENTION

This invention is an Adjustable Lift Bar System for roll off containers and for other various applications. The purpose of the Adjustable Lift Bar System is to enable a roll off (or any other straight truck frame roller lift implement) to be compatible with a lift bar hoist system set at 36", 54" and 62". The Adjustable Lift Bar System can also interchange a 1.5" Ø and 2.5" Ø Lift Bar. The purpose of the Adjustable Lift Bar System is to enable a roll off (or any other straight truck frame roller lift implement) to be compatible with a lift bar hoist system set at 36", 54" and 62". The Adjustable Lift Bar System can also interchange a 1.5" Ø and 2.5" Ø Lift Bar.

The preferred embodiment of the Adjustable Lift Bar System is comprised of: (a) a lift bar assembly consisting of: (1) a lift bar having a crown; (2) a pair (left and right) of lift bar flanges; (3) a pair of mounting flanges with a set of apertures to receive a group of removable fasteners, the mounting flanges placed contiguous to a vertical support when assembled to a roll off container; (4) a long spreader tube placed between the mounting flanges and secured to each flange at each end by a fastening means such as welding or the like; (5) a pair (left and right) of short spreader tubes whereby each of the pair is placed between a mounting flange and a lift bar flange and secured at each end to mounting flange and lift bar flange by a fastening means such as welding or the like; (b) a pair (left and right) of bolt plates each with a series of apertures and each secured contiguously to a pair of vertical supports by a fastening means such as welding or the like; (c) the pair of vertical supports [existing on the roll off container or added as part of the adjustable lift system] secured to the roll off container by a fastening means such as welding or the like; (d) the means, such as a set of threaded bolts, nuts and washers or equal, to removably fasten each of the pair of the mounting flanges of the lift bar assembly to each of the pair (left and right) of the bolt plates, the means being placed through the apertures of the bolt plate and the apertures of the mounting flanges wherein the lift bar assembly is adjustably and removably secured to the bolt plates which have been fixedly secured to the roll off container.

The newly invented Adjustable Lift Bar System may be manufactured at low volumes by very simple means and in high volume production by more complex and controlled systems.

OBJECTS AND ADVANTAGES

There are several objects and advantages of the Adjustable Lift Bar System.

TABLE A

| Item | Advantages |
|---|---|
| 1 | Adjustable for various height roll offs |
| 2 | Useful for short, medium, and long roll off containers |
| 3 | Can be fitted for new roll off containers |
| 4 | Can be fitted for existing/aftermarket container |
| 5 | Versatile for various truck systems |
| 6 | Mountable/adjustable with simple wrench and lift |

Finally, other advantages and additional features of the present Adjustable Lift Bar System will be more apparent from the accompanying drawings and from the full description of the device. For one skilled in the art of roll off containers and the methods of handling them, it is readily understood that the features shown in the examples with this product are readily adapted to other types of improvements to Adjustable Lift Bar devices and systems.

DESCRIPTION OF THE DRAWINGS—FIGURES

The accompanying drawings, which are incorporated in and constitute a part of this specification, illustrate an embodiment of the Adjustable Lift Bar System for various applications device that is preferred. The drawings together with the summary description given above and a detailed description given below explain the principles of the Adjustable Lift Bar System. It is understood, however, that the Adjustable Lift Bar System is not limited to only the precise arrangements and instrumentalities shown.

FIGS. 1 A through 1 C are sketches of the general Adjustable Lift Bar System.

FIGS. 2 A through 2 D are sketches of the general Adjustable Lift Bar System Prototype and Short Adjustable Lift Bar System Prototype with components and features noted.

FIGS. 3 A and 3 B are sketches of the Adjustable Lift Bar System with the components and features shown from generally front and side views.

FIGS. 6 A through 6 H are sketches of the Adjustable Lift Bar System and alternative short Adjustable Lift Bar System with components and features shown and the Adjustable Lift Bar System mounted to a roll off.

Figures 7A, 7B, 7C, 7D, 7E, 7F:
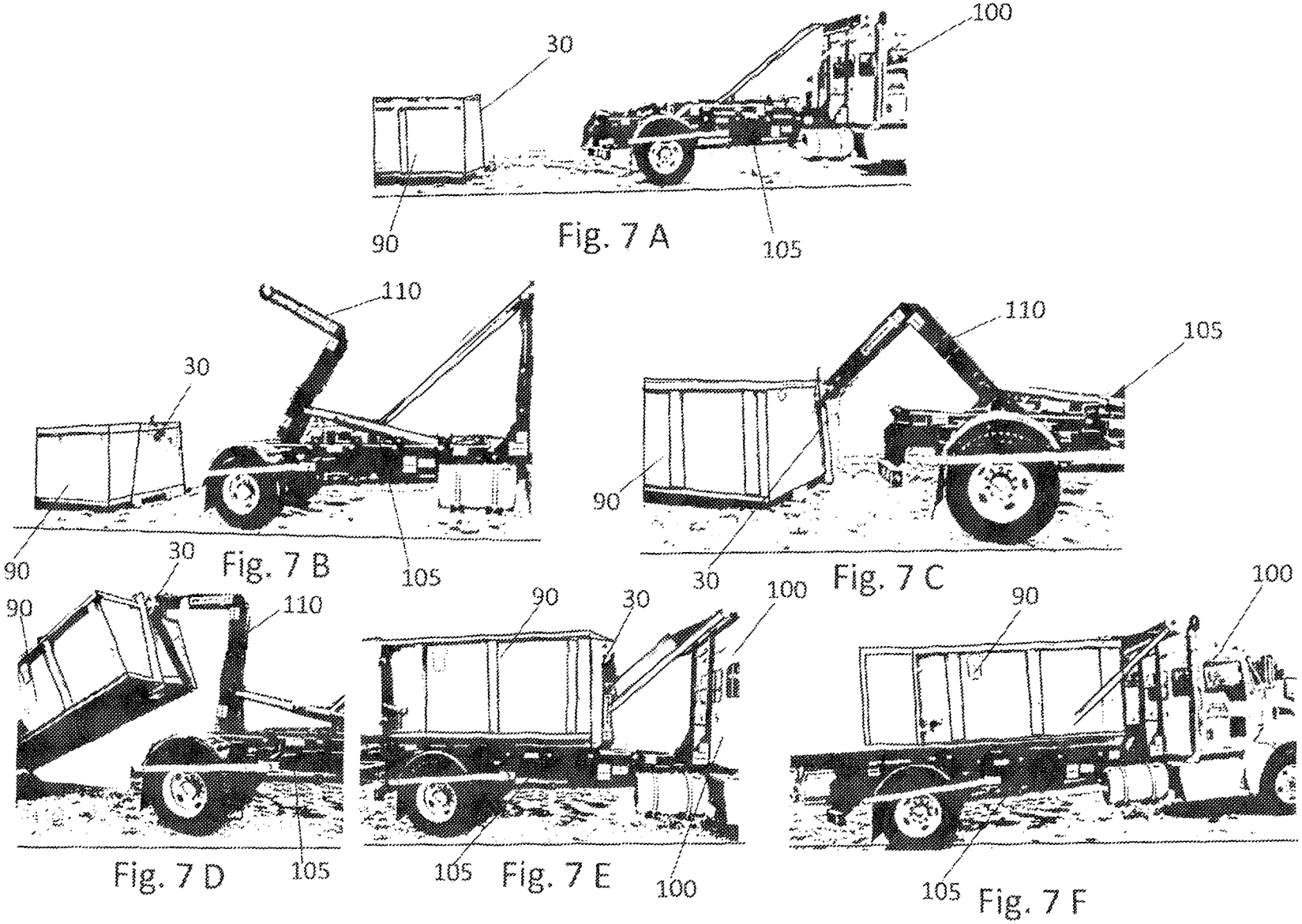
Figure 8A:
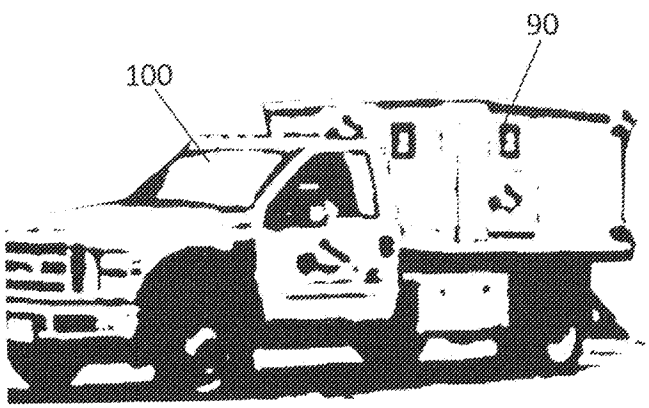
Figure 8B:
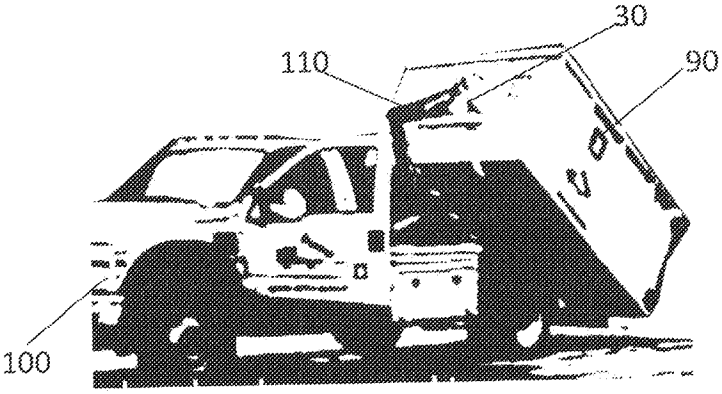
Figure 8C:
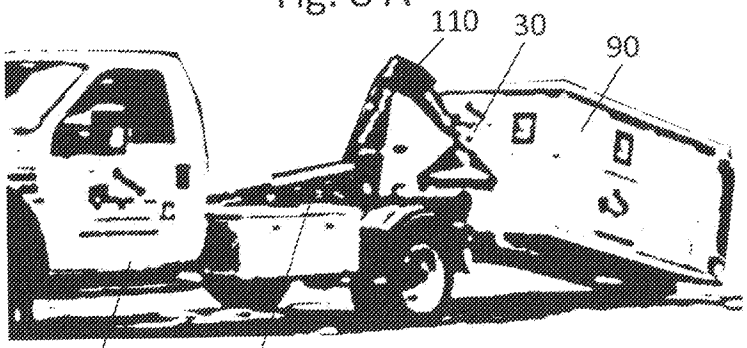
Figure 8D:
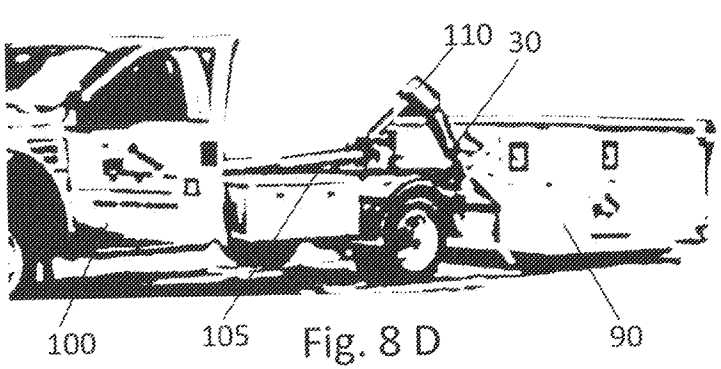
Figure 8E:
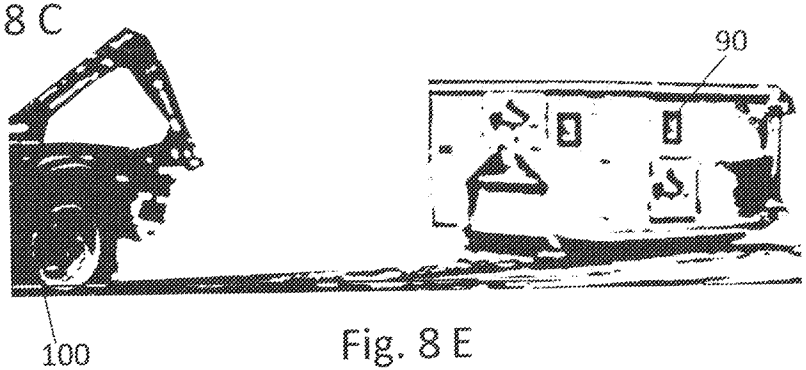

FIGS. 7 A through 7 F are sketches of a roll off pick up using the Adjustable Lift Bar System.

FIG. 8 through 8 E are sketches of a small roll off pick up using the Adjustable Lift Bar System.

FIG. 9 through 9 E are sketches of prior art for roll off container systems.

DESCRIPTION OF THE DRAWINGS—REFERENCE NUMERALS

The following list refers to the drawings:

TABLE B

| Reference numbers | |
|---|---|
| Ref # | Description |
| 30 | adjustable lift bar system 30 for roll off containers 90 |
| 31 | Prototype 31 of the adjustable lift bar system 30 |
| 33 | alternative short adjustable lift bar system 33 for roll off containers 90 |
| 35 | prototype 35 of the alternative short adjustable lift bar system 33 for roll off containers 90 |
| 37 | lift bar drawing 37 |
| 38 | adjustable lift bar system drawing 38 |
| 39 | adjustable side bar bolt plate drawing 39 |
| 40 | lift bar assembly 40 |
| 40A | lift bar 40A (approximately 1.5-to-2.5-inch diameter) with crown 41 to center hook of lifting arm 110 |
| 41 | crown 41 to center hook of lifting arm 110 |
| 43 | pair of lift bar flanges 43 |
| 44 | pair of mounting flanges 44 (left and right) placed contiguous to the bolt plate 50 |
| 44A | aperture 44A to receive the removable means 70 |
| 46 | long spreader tube 46 (round, oval, square) |
| 47 | short spreader tube 47 (round, oval, square) |
| 49 | means for fastening 49 (weld, integrally formed, machined, or the like) |
| 50 | bolt plate 50 fastened or welded to vertical support 60 |
| 52 | aperture 52 for bolt 50 |
| 53 | length 53 of bolt plate 50 |
| 54 | width 54 of bolt plate 50 |
| 60 | vertical support 60 on roll off 90 (existing or added depending on roll off manufacturer) square tube, channel, I or H beam, angle, Tee or the like |
| 65 | gussets 65 all welded between the vertical supports 60, short spreader tube 47, bolt plate 50, end surface 92 of the roll off container 90, and the top tube structure 95 of the roll off container 90, and the bolt plate 50 |
| 70 | means for fastening 70 threaded bolt, nut and washer sized approximately 1.00-inch diameter and larger (minimum 3 each side); removable heavy-duty rivet with washer and heavy cotter pin; |
| 90 | roll off container 90 |
| 92 | end surface 92 of the roll off container 90 |
| 95 | top tube structure 95 of the roll off container 90 |
| 100 | tractor 100 |
| 105 | roll off system 105 on tractor 100 |
| 110 | lifting arm 110 |
| 120 | prior Art 120 U.S Pat. No. 3,971,486 |
| 121 | prior Art 121 U.S Pat. No. 3,987,918 |
| 122 | prior Art 122 U.S Pat. No. 7,883,310 |

TABLE B-continued

| Reference numbers | |
|---|---|
| Ref # | Description |
| 123 | prior Art 123 U.S Pat. No. 10,131,264 |
| 124 | prior Art 124 U.S Patent Publication 2007/0237617 |

DETAILED DESCRIPTION OF PREFERRED EMBODIMENT

This invention relates to an Adjustable Lift Bar System. It is an improvement to a roll off system which is an apparatus for handling, loading, unloading and transporting containers, load supporting bodies, pallets and like bulky and heavy objects. The Adjustable Lift Bar System is available for new or refurbished devices that provide a dumpster and lifting arm of the type for lifting the dumpster and dumping the contents of the dumpster into a storage box or, in the waste disposal industry, for disposal of waste material to a landfill or farm field. The present invention deals with the field of vehicles designed for the purpose of transporting containers such as refuse containers which includes a hook lift jib apparatus along with a powered cylinder member for the purpose of placement and removal of such a container relative to a position of rest upon the rear of the vehicle such as a transport truck or the like. The improvement—an Adjustable Lift Bar System—permits the ability to use one roll off container with truck and arm systems of various sizes. This can be original equipment or refurbished units that allow for the various sized trucks and roll off containers to be used together as well as switched to other trucks in the future. This invention offers a uniquely universal construction because it is can be used for handling and transporting containers of various sizes and configurations while maintaining the same hook lift jib apparatus and the same powering system.

The advantages for the Adjustable Lift Bar System 30 are listed above in the introduction. Succinctly the benefits are that the device:

Adjustable for various height roll offs;

Useful for short, medium, and long roll off containers;

Can be fitted for new roll off containers;

Can be fitted for existing/aftermarket container;

Versatile for various truck systems;

Mountable/adjustable with simple wrench and lift;

The preferred embodiment of the Adjustable Lift Bar System is comprised of: (a) a lift bar assembly 40 consisting of: (1) a lift bar 40A having a crown 41; (2) a pair (left and right) of lift bar flanges 43; (3) a pair of mounting flanges 44 with a set of apertures 44A to receive a group of removable means for fastening 70, the mounting flanges placed contiguous to a vertical support 60 when assembled to a roll off container 90; (4) a long spreader tube 46 placed between the mounting flanges 44 and secured to each flange 44 at each end by a means for fastening 49 (weld, integrally formed, machined, or the like); (5) a pair (left and right) of short spreader tubes 47 whereby each of the pair is placed between a mounting flange 44 and a lift bar flange 43 and secured at each end to mounting flange 44 and lift bar flange 43 by a means for fastening 49 (weld, integrally formed, machined, or the like); (b) a pair (left and right) of bolt plates 50 each with a series of apertures 52 and each secured contiguously to a pair of vertical supports 60 by a means for fastening 49 (weld, integrally formed, machined, or the like); (c) the pair of vertical supports 60 [existing on the roll off container 90 or added as part of the adjustable lift system—square tube, channel, I or H beam, angle, Tee or the like] secured to the roll off container by a means for fastening 49 (weld, integrally formed, machined, or the like); (d) the means for fastening 70 threaded bolt, nut and washer sized approximately 1.00 inch diameter and larger (minimum 3 each side); removable heavy duty rivet with washer and heavy cotter pin, to removably fasten each of the pair of the mounting flanges 44 of the lift bar assembly 40 to each of the pair (left and right) of the bolt plates 50, the means for fastening 70 being placed through the apertures 52 of the bolt plate 50 and the apertures 44A of the mounting flanges 44 wherein the lift bar assembly 40 is adjustably and removably secured to the bolt plates 50 which have been fixedly secured to the roll off container 90.

There is shown in FIGS. 1-9 a complete description and operative embodiment of the Adjustable Lift Bar System 30. In the drawings and illustrations, one notes well that the FIGS. 1-9 demonstrate the general configuration and use of this system. The various example uses are in the operation and use section, below.

The accompanying drawings, which are incorporated in and constitute a part of this specification, illustrate an embodiment of the Adjustable Lift Bar System 30 that is preferred. The drawings together with the summary description given above and a detailed description given below explain the principles of the Adjustable Lift Bar System 30. It is understood, however, that the Adjustable Lift Bar System 30 is not limited to only the precise arrangements and instrumentalities shown. Other examples of improvements to roll off carriers and uses are still understood by one skilled in the art of roll off and machine deck devices and improvements thereof to be within the scope and spirit shown here.

Figure 1B:
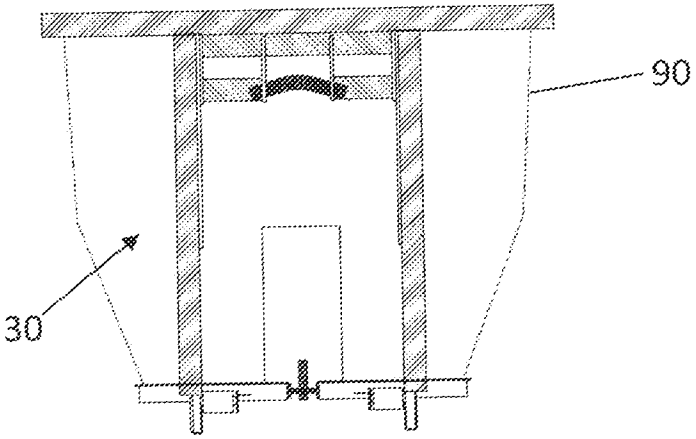
Figure 1C:
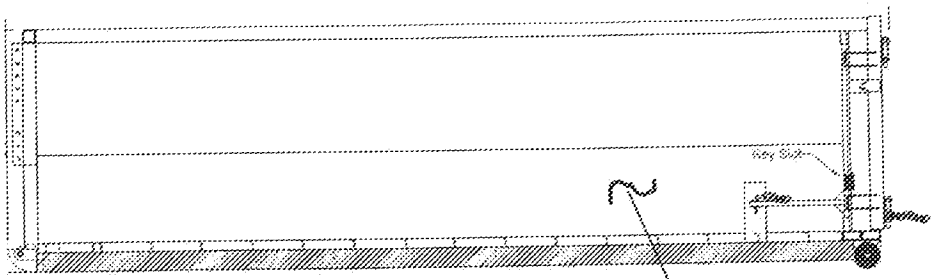
Figure 1A:
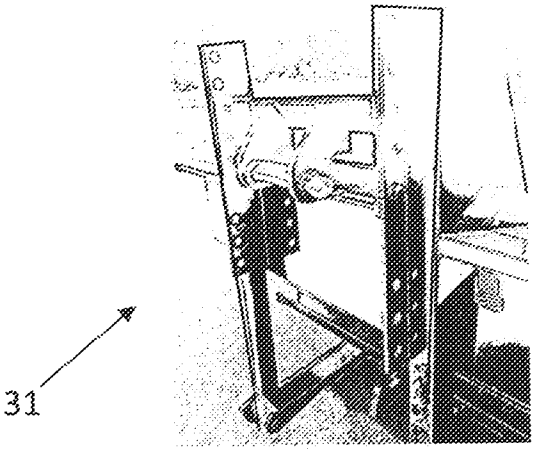
Figure 2C:
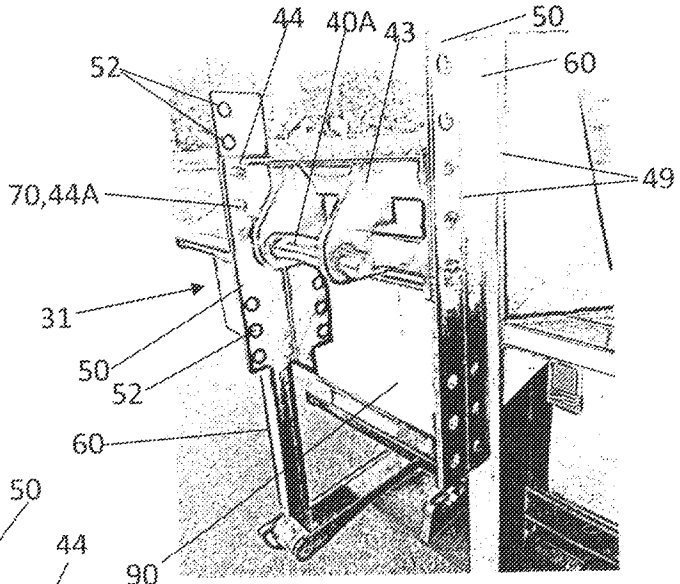
Figure 2B:
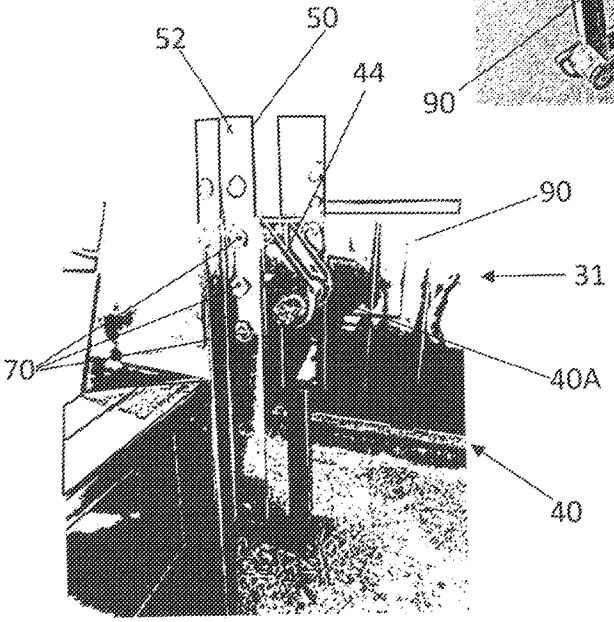
Figure 2D:
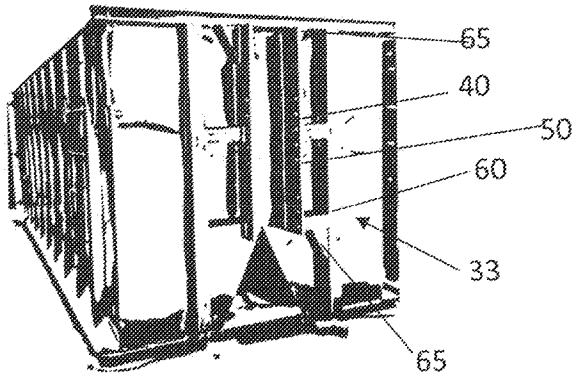
Figure 2A:
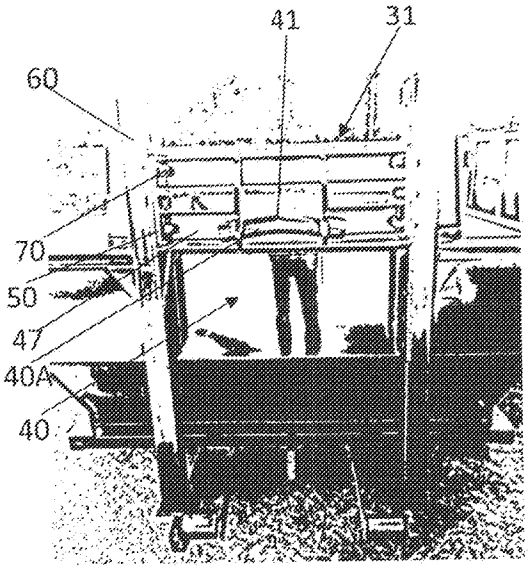

FIGS. 1 A through 1 C are sketches of the general Adjustable Lift Bar System 30. Shown in these drawings are: an adjustable lift bar system 30 for roll off containers 90; a prototype 31 of the adjustable lift bar system 30; and a roll off container 90.

FIGS. 2 A through 2 D are sketches of the general Adjustable Lift Bar System Prototype 31 and Short Adjustable Lift Bar System Prototype 35 with components and features noted. Demonstrated in these drawings are the following: an adjustable lift bar system 30 for roll off containers 90; a prototype 31 of the adjustable lift bar system 30; a lift bar assembly 40; a lift bar 40A (approximately 1.5 to 2.5 inch diameter) with a crown 41 to center hook of lifting arm 110; a crown 41 to center hook of lifting arm 110; a pair of lift bar flanges 43; a pair of mounting flanges 44 (left and right) placed contiguous to the bolt plate 50; a long spreader tube 46 (round, oval, square); a short spreader tube 47 (round, oval, square); means for fastening 49 (weld, integrally formed, machined, or the like); a bolt plate 50 fastened or welded to vertical support 60; a vertical support 60 on roll off 90 (existing or added depending on roll off manufacturer—square tube, channel, I or H beam, angle, Tee or the like); and a means for fastening 70 bolt and nut sized approximately 1.00 inch diameter and larger (minimum 3 each side); and a roll off container 90.

Figure 3B:
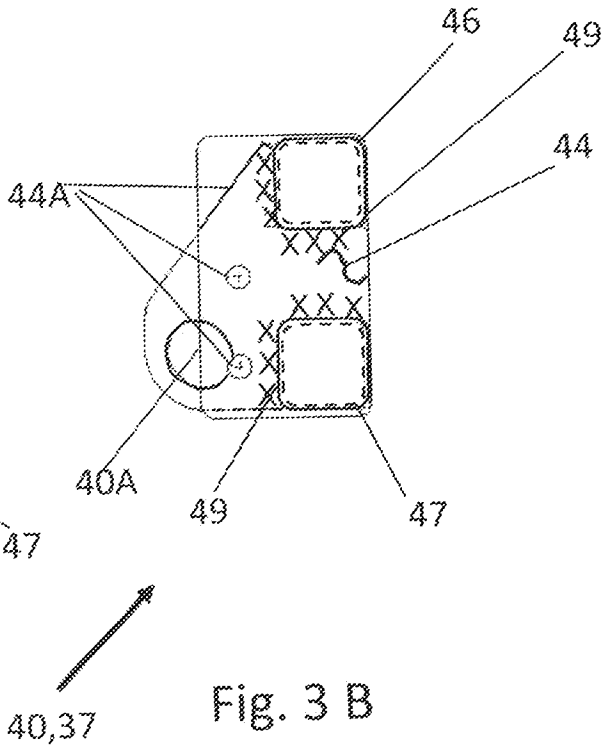
Figure 3A:
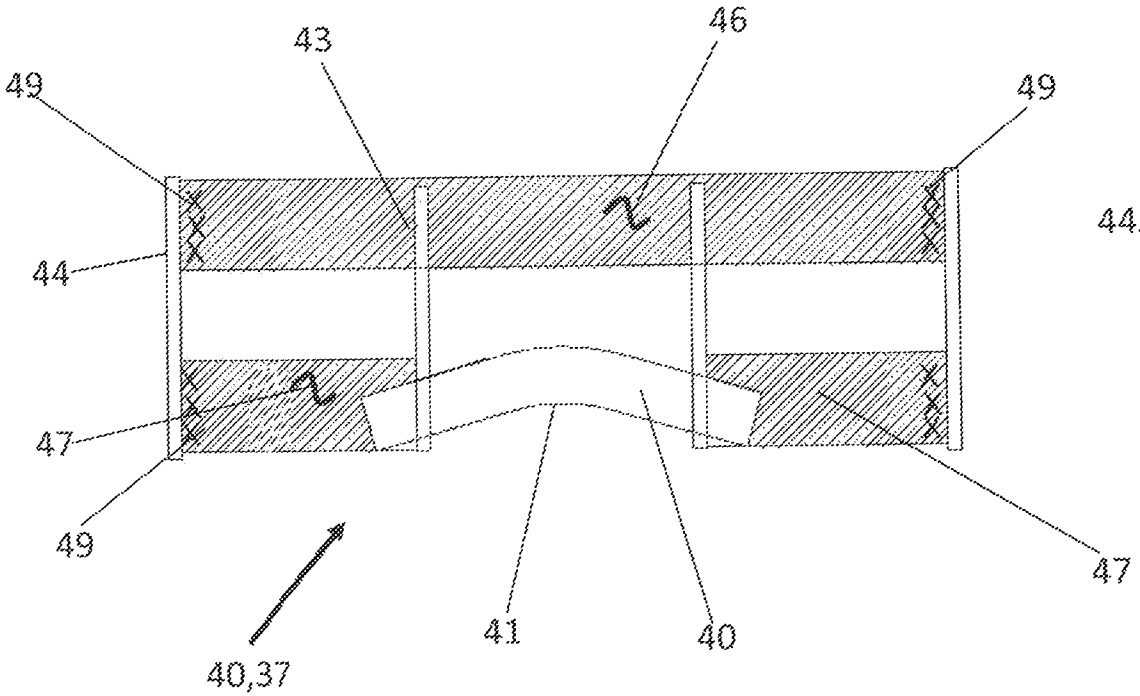

FIGS. 3 A and 3 B are sketches of the Adjustable Lift Bar System 30 with the components and features shown from generally front and side views. Provided in this view include: a lift bar drawing 37; a lift bar assembly 40; a lift bar 40A (approximately 1.5 to 2.5 inch diameter) with a crown 41 to center hook of lifting arm 110; a crown 41 to center hook of lifting arm 110; a pair of lift bar flanges 43; a pair of mounting flanges 44 (left and right) placed contiguous to the bolt plate 50; an aperture 44A to receive the removable means for fastening 70; a long spreader tube 46 (round, oval, square); a short spreader tube 47 (round, oval, square); and a means for fastening 49 (weld, integrally formed, machined, or the like).

Figure 4:
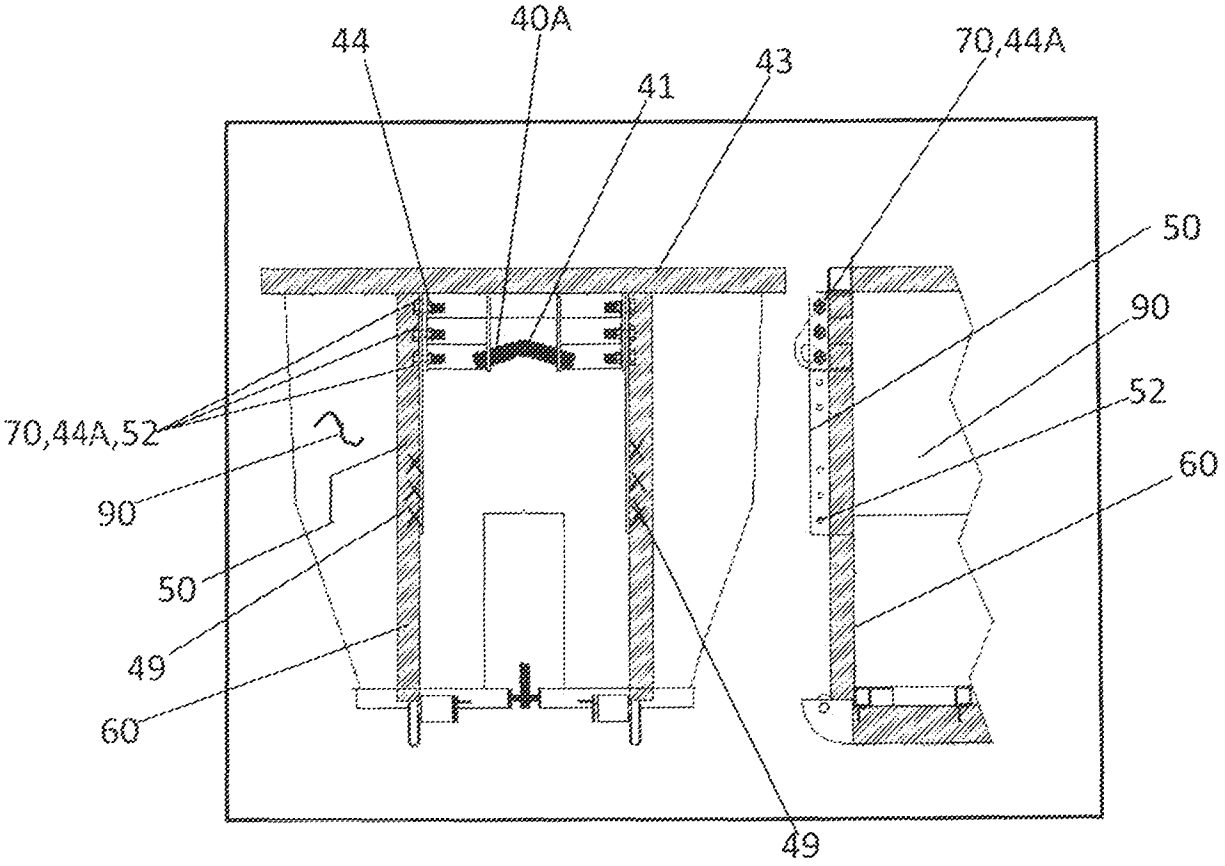
FIG. 4 is a sketch of the Adjustable Lift Bar System from a front and side view.

FIG. 4 is a sketch 38 of the Adjustable Lift Bar System 30 from a front and side view. Shown here are components and features as follows: an adjustable lift bar system 30 for roll off containers 90; an adjustable lift bar system drawing 38; a lift bar assembly 40; a lift bar 40A (approximately 1.5 to 2.5 inch diameter) with a crown 41 to center hook of lifting arm 110; a crown 41 to center hook of lifting arm 110; a pair of lift bar flanges 43; a pair of mounting flanges 44 (left and right) placed contiguous to the bolt plate 50; an aperture 44A to receive the removable means for fastening 70; a bolt plate 50 fastened or welded to vertical support 60; an aperture 52 for bolt 50; a vertical support 60 on roll off 90 (existing or added depending on roll off manufacturer—square tube, channel, I or H beam, angle, Tee or the like); a means for fastening 70 bolt and nut sized approximately 1.00 inch diameter and larger (minimum 3 each side) or a rivet with a cotter pin; and a roll off container 90.

Figure 5:
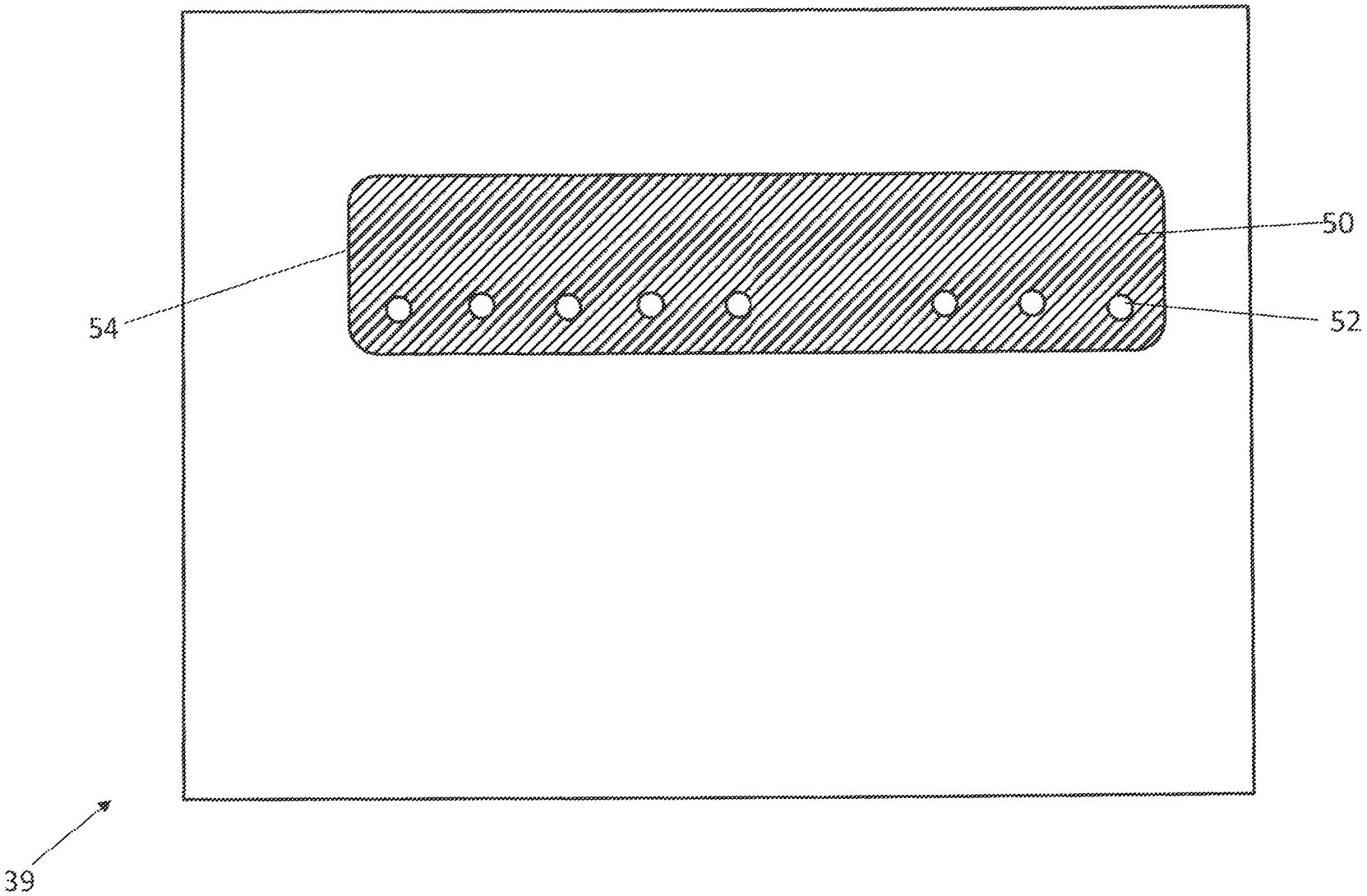
FIG. 5 is a sketch of the bolt plate for the Adjustable Lift Bar System.
Figure 6C:
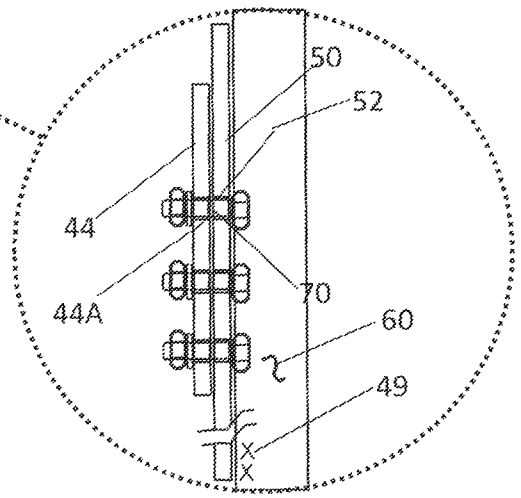
Figure 6A:
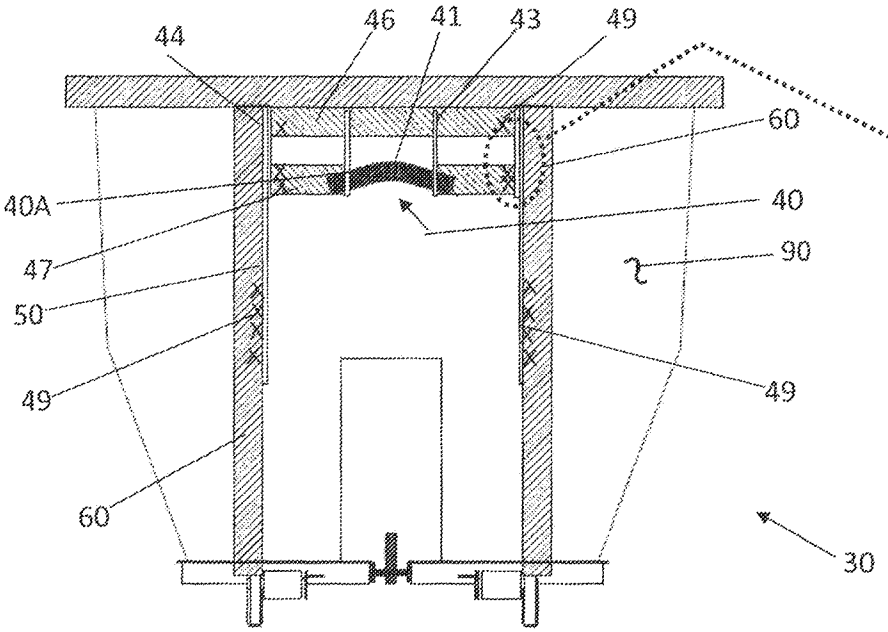
Figure 6B:
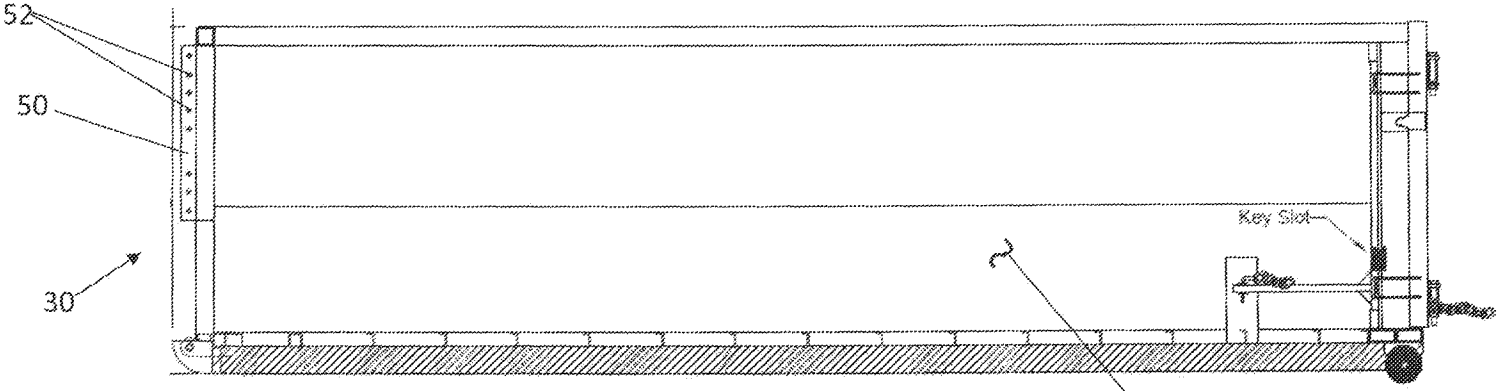
Figures 6D, 6E, 6F, 6G, 6H:
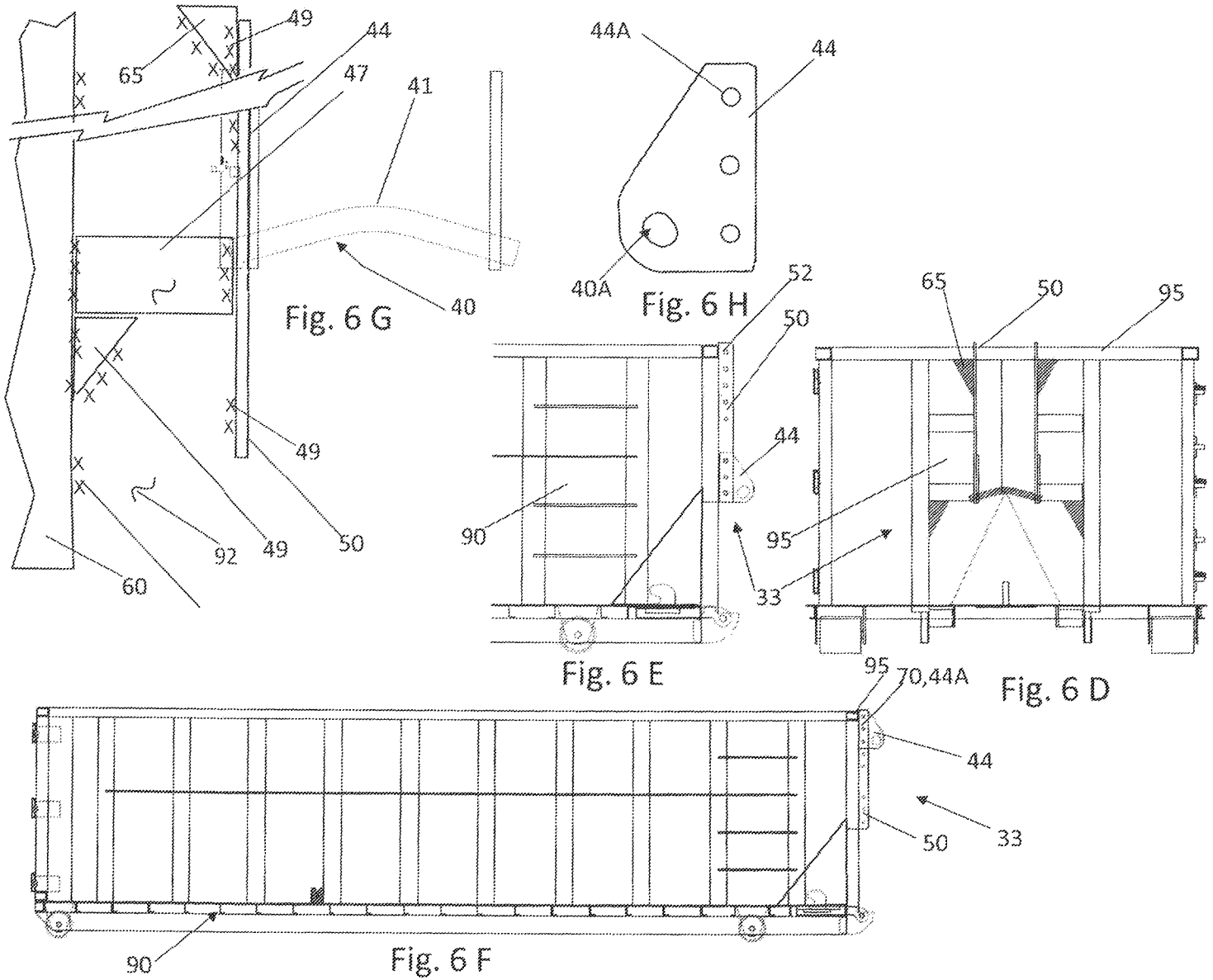

FIG. 5 is a sketch 39 of the bolt plate 50 for the Adjustable Lift Bar System 30. This drawing shows: an adjustable side bar bolt plate drawing 39; a bolt plate 50 to be fastened or welded to vertical support 60; a set of apertures 52 for means for fastening 70; a length 53 of bolt plate 50; and a width 54 of bolt plate 50. All the materials for the lift bar system anticipate being rigid, durable, and machinable. This includes, but is not limited to steel, steel alloys, stainless steel, high strength composite materials and the like.

FIGS. 6 A through 6 H are sketches of the Adjustable Lift Bar System 30 and alternative short Adjustable Lift Bar System 33 with components and features shown and the Adjustable Lift Bar System mounted to a roll off. FIGS. 6 A through 6 C are sketches of the Adjustable Lift Bar System 30 with components and features shown and all the Adjustable Lift Bar System 30 mounted to a roll off container 90. Presented by these views are: an adjustable lift bar system 30 for roll off containers 90; a lift bar assembly 40; a lift bar 40A (approximately 1.5 to 2.5 inch diameter) with a crown 41 to center hook of lifting arm 110; the crown 41 to center hook of lifting arm 110; a pair of lift bar flanges 43; a pair of mounting flanges 44 (left and right) placed contiguous to the bolt plate 50; an aperture 44A to receive the removable means for fastening 70; a long spreader tube 46 (round, oval, square); a short spreader tube 47 (round, oval, square); a means for fastening 49 (weld, formal, or the like); a bolt plate 50 fastened or welded to vertical support 60; an aperture 52 for bolt 50; a vertical support 50 on roll off 90 (existing or added depending on roll off manufacturer; a means for fastening 70 bolt and nut sized approximately 1.00 inch diameter and larger (minimum 3 each side); and a roll off container 90. FIGS. 6 D through 6 H are sketches of the alternative Short Adjustable Lift Bar System 33. The short system 33 uses more welding of four or more gussets 65 a second pair all welded between the vertical supports 60 and a set of four short spreader tubes 47 and a first pair of gussets welded between a pair of bolt plates 50, an end surface 92 of the roll off container 90, and the top tube structure 95 of the roll off container 90. Most of the other components are like or like those shown above for FIGS. 6 A through 6 C.

FIGS. 7 A through 7 F are sketches of a roll off pick up using the Adjustable Lift Bar System. FIG. 8 through 8 E are sketches of a small roll off pick up using the Adjustable Lift Bar System. These are described below in the operations Section.

FIG. 9 through 9 E are sketches of prior art for roll off container systems. These include prior Art 120 U.S. Pat. No. 3,971,486; prior Art 121 U.S. Pat. No. 3,987,918; prior Art 122 U.S. Pat. No. 7,883,310; prior Art 123 U.S. Pat. No. 10,131,264; and prior Art 124 Publication of a Patent Application 2007/0237617. As can be seen, the Adjustable Lift Bar System 30 is a unique combination and use as described herein.

The details mentioned here are exemplary and not limiting. Other specific components and manners specific to describing an Adjustable Lift Bar System 30 may be added as a person having ordinary skill in the field of the art of roll off and machine deck devices and improvements thereof and their uses well appreciates.

Operation of the Preferred Embodiment

The Adjustable Lift Bar System 30 has been described in the above embodiment. The manner of how the device operates is described below. One notes well that the description above and the operation described here must be taken together to fully illustrate the concept of the Adjustable Lift Bar System 30. The preferred embodiment of the Adjustable Lift Bar System is comprised of: (a) a lift bar assembly 40 consisting of: (1) a lift bar 40A having a crown 41; (2) a pair (left and right) of lift bar flanges 43; (3) a pair of mounting flanges 44 with a set of apertures 44A to receive a group of removable means for fastening 70, the mounting flanges placed contiguous to a vertical support 60 when assembled to a roll off container 90; (4) a long spreader tube 46 placed between the mounting flanges 44 and secured to each flange 44 at each end by a means for fastening 49 (weld, integrally formed, machined, or the like); (5) a pair (left and right) of short spreader tubes 47 whereby each of the pair is placed between a mounting flange 44 and a lift bar flange 43 and secured at each end to mounting flange 44 and lift bar flange 43 by a means for fastening 49 (weld, integrally formed, machined, or the like); (b) a pair (left and right) of bolt plates 50 each with a series of apertures 52 and each secured contiguously to a pair of vertical supports 60 by a means for fastening 49 (weld, integrally formed, machined, or the like); (c) the pair of vertical supports 60 [existing on the roll off container or added as part of the adjustable lift system] secured to the roll off container by a means for fastening 49 (weld, integrally formed, machined, or the like); (d) the means for fastening 70, such as a set of threaded bolts, nuts and washers or equal, to removably fasten each of the pair of the mounting flanges 44 of the lift bar assembly 40 to each of the pair (left and right) of the bolt plates 50, the means for fastening 70 being placed through the apertures 52 of the bolt plate 50 and the apertures 44A of the mounting flanges 44 wherein the lift bar assembly is adjustably and removably secured to the bolt plates 50 which have been fixedly secured to the roll off container 90. An alternative embodiment is a Short Adjustable Lift Bar System 33 for a roll off container 90 with an existing pair of vertical supports 60 which are rigidly secured to the roll off container, the adjustable lift bar system 33 is made of rigid, durable, and machinable materials and is comprised of: (a) a left- and right-hand pair of bolt plates 50 each with a series of apertures 52 fixedly welded to a first pair of gusset plates that are in turn fixedly welded to a top tube structure (95) of the roll off container 90 and an end surface 92 of the roll off container 90 and each of the two left- and right-hand pair of bolt plates further fixedly welded along a side contiguous to the end surface 92 of the roll off container 90 and further fixedly welded to an end of two sets, an upper set and a lower set, of a left- and right-hand pair of short spreader tubes 47, that end being closest to the center of the end of a roll off container; (b) the two sets of a left- and right-hand pair of short spreader tubes 47 whereby the upper set is placed midway between the top tube structure 95 and the lower set and whereby the lower set has a second pair of gusset plates that are in turn fixedly welded to the pair of existing vertical structure and an end surface 92 of the roll off container (90) and whereby each set is fixedly welded at the end opposite with that opposite end being farthest from the center of the end of a roll off container and that opposite end being contiguous and fixedly welded to each of the pair of existing vertical support structures and whereby the lower set is placed; and (c) a lift bar assembly 40 consisting of: (1) a lift bar 40A having a crown 41; (3) the left- and right-hand pair of mounting flanges 44 with a set of apertures 44A to receive a group of removable means for fastening 70, the mounting flanges 44 placed contiguous to a left- and right-hand pair of bolt plates 50 each with a series of apertures 52 aligned with the set of apertures 44A wherein the lift bar assembly 40 is adjustably and removably secured to the bolt plates 50 which have been previously fixedly secured to the roll off container 90.

FIGS. 7 A through 7 F are sketches of a roll off pick up using the Adjustable Lift Bar System. FIG. 8 through 8 E are sketches of a small roll off pick up using the Adjustable Lift Bar System. Shown here are: an adjustable lift bar system 30 for roll off containers 90; a roll off container 90; a tractor 100; a roll off system 105 on tractor 100 and a lifting arm 110. The way the roll off containers are loaded and unloaded are generally as follows: To load a roll-off container, the roll-off truck is backed up to the roll-off container, the bed of the roll-off truck is tilted, the hoisting mechanism is engaged with the attachment fitting of the roll-off container, and the roll-off container is drawn towards and onto the tilted truck bed. Then the bed is returned to a horizontal orientation for transporting the roll-off container. See FIG. 1. To unload the roll-off container, the truck bed is tilted, and the hoisting mechanism is reversed, whereby the roll-off container slides downward and rearward off the truck bed. In addition, to change out a container on a hook lift, the hook lift system typically employs a series of hydraulic rams to hook the container, and then subsequently lift and hoist the container onto the chassis of a heavy-duty truck designed to operate the hook lift. The container is then secured onto the truck and transported to another location where the container can be dumped or unloaded, and the hook lift is then free again to hoist and transport another body or container.

The Adjustable Lift Bar System 30 is typically assembled as follows: A. The lift bar assembly 40 is built as a weldment (see FIG. 3) with a lift bar 40A (approximately 1.5-to-2.5-inch diameter) having a crown 41 to center hook of lifting arm 110 and a pair of lift bar flanges 43 welded at each end of the lift bar 40A. The lift bar flanges 43 are also each welded to a first end of the short spreader tube 47. A pair of mounting flanges 44 (left and right) are next placed at the opposite end of a long spreader tube 46 (round, oval, square). Note that these mounting flanges 44 have apertures 44A to eventually receive a means for fastening 70 (see FIG. 6 expanded view). Then each of a second (left and right) ends of the pair of short spreader tubes 47 are welded to the same mounting flanges 44. The components of the lift bar assembly 40 has a means for fastening 49 (weld, integrally formed, machined, or the like). B. Bolt plate 50 (See FIGS. 4, 5, and 6) is a pair of plates 50 with apertures 52 to receive a means for fastening 70 (see FIG. 6 expanded view). C. Vertical support 60 (existing with the roll off 90 or added as part of the Adjustable Lift Bar System 30. The pair of vertical supports 60 are welded to the roll off container each in a vertical position. Next the pair of bolt plates 50 (with apertures 52 to receive the means for fastening 70 (see FIG. 4 and FIG. 6 expanded view). Depending on the height desired for the lift bar 40A and crown 41, the lift bar assembly 40 is placed between the pair of bolt plates 50. The desired height is attained by lifting the lift bar assembly 40 vertically with a fork truck, jack or hoist. Once the desired height is achieved, the apertures 44A (of the mounting flanges 44) and the apertures 52 of the bolt plate are aligned. An alignment pin or draft may be useful to align these apertures 52, 44A. The means for fastening 70 (bolts) are placed through the apertures 44A, 52 and the washers and nuts are tightened. Finally, the forklift, hoist or jack is removed, and the Adjustable Lift Bar System 30 is assembled to the roll off container 90 and ready for use.

Many uses are anticipated for Adjustable Lift Bar System 30. Some examples, and not limitations, are shown in the following Table C:

| Item | Uses |
|---|---|
| 1 | Roll-off container systems |
| 2 | Standard size hopper container systems |
| 3 | Machine base/platform system |
| 4 | Miscellaneous pick-up systems |

With this description it is to be understood that the Adjustable Lift Bar System 30 is not to be limited to only the disclosed embodiment of product. The features of the Adjustable Lift Bar System 30 are intended to cover various modifications and equivalent arrangements included within the spirit and scope of the description.

While certain novel features of this invention have been shown and described and are pointed out in the annexed claims, it is not intended to be limited to the details above, since it will be understood that various omissions, modifications, substitutions and changes in the forms and details of the device illustrated and, in its operation, can be made by those skilled in the art without departing in any way from the spirit of the present invention. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

Unless defined otherwise, all technical and scientific terms used herein have the same meaning as commonly understood by one of ordinary skill in the art to which these inventions belong. Although any methods and materials similar or equivalent to those described herein can also be used in the practice or testing of the present inventions, the preferred methods and materials are now described above in the foregoing paragraphs.

Other embodiments of the invention are possible. Although the description above contains much specificity, these should not be construed as limiting the scope of the invention, but as merely providing illustrations of some of the presently preferred embodiments of this invention. It is also contemplated that various combinations or sub-combinations of the specific features and aspects of the embodiments may be made and still fall within the scope of the inventions. Various features and aspects of the disclosed embodiments can be combined with or substituted for one another to form varying modes of the disclosed inventions. Thus, it is intended that the scope of at least some of the present inventions herein disclosed should not be limited by the particularly disclosed embodiments described above.

The terms recited in the claims should be given their ordinary and customary meaning as determined by reference to relevant entries (e.g., definition of "plane" as a carpenter's tool would not be relevant to the use of the term "plane" when used to refer to an airplane, etc.) in dictionaries (e.g., widely used general reference dictionaries and/or relevant technical dictionaries), commonly understood meanings by those in the art, etc., with the understanding that the broadest meaning imparted by any one or combination of these sources should be given to the claim terms (e.g., two or more relevant dictionary entries should be combined to provide the broadest meaning of the combination of entries, etc.) subject only to the following exceptions: (a) if a term is used herein in a manner more expansive than its ordinary and customary meaning, the term should be given its ordinary and customary meaning plus the additional expansive meaning, or (b) if a term has been explicitly defined to have a different meaning by reciting the term followed by the phrase "as used herein shall mean" or similar language (e.g., "herein this term means," "as defined herein," "for the purposes of this disclosure [the term] shall mean," etc.). References to specific examples, use of "i.e.," use of the word "invention," etc., are not meant to invoke exception (b) or otherwise restrict the scope of the recited claim terms. Other than situations where exception (b) applies, nothing contained herein should be considered a disclaimer or disavowal of claim scope. Accordingly, the subject matter recited in the claims is not coextensive with and should not be interpreted to be coextensive with any particular embodiment, feature, or combination of features shown herein. This is true even if only a single embodiment of the particular feature or combination of features is illustrated and described herein. Thus, the appended claims should be read to be given their broadest interpretation in view of the prior art and the ordinary meaning of the claim terms.

Unless otherwise indicated, all numbers or expressions, such as those expressing dimensions, physical characteristics, etc. used in the specification (other than the claims) are understood as modified in all instances by the term "approximately." At the very least, and not as an attempt to limit the application of the doctrine of equivalents to the claims, each numerical parameter recited in the specification or claims which is modified by the term "approximately" should at least be construed considering the number of recited significant digits and by applying ordinary rounding techniques.

The present invention contemplates modifications as would occur to those skilled in the art. While the disclosure has been illustrated and described in detail in the figures and the foregoing description, the same is to be considered as illustrative and not restrictive in character, it being understood that only selected embodiments have been shown and described and that all changes, modifications and equivalents that come within the spirit of the disclosures described heretofore and or/defined by the following claims are desired to be protected.

What is claimed is:

1. An Adjustable Lift Bar System (30) for a roll off container (90) with an existing pair of vertical supports (60) which are rigidly secured to the roll off container, the adjustable lift bar system (30) is made of rigid, durable, and machinable materials and is comprised of:

(a) a lift bar assembly (40) including: (1) a lift bar (40A) having a crown (41); (2) a left- and right-handed pair of lift bar flanges (43); (3) a pair of mounting flanges (44) with a set of apertures (44A) to receive a group of removable means for fastening (70), the mounting flanges (44) for being placed contiguous to each of the existing pair of vertical supports (60) of the roll off container (90); (4) a long spreader tube (46) placed at a top of the lift bar assembly (40), between the mounting flanges (44), and secured to each flange (44) at each end by a means for fastening (49); (5) a left- and right-hand pair of short spreader tubes (47) whereby each of the pair of short spreader tubes is placed at a bottom of the lift bar assembly (40) between a respective one of the mounting flanges (44) and a respective one of the lift bar flanges (43) and secured at each end to the respective one of the mounting flanges (44) and the respective one of the lift bar flanges (43) by a means for fastening (49);

(b) a left- and right-hand pair of bolt plates (50) each with a series of apertures (52) and each for being fixedly secured contiguously to the existing pair of the vertical supports (60) by a means for fastening (49); and (c) the removable means for fastening (70), used to removably fasten each of the pair of the mounting flanges (44) of the lift bar assembly (40) to each of the pair of the bolt plates (50), the removable means for fastening (70) being placed through the apertures (52) of the bolt plate (50) and the apertures (44A) of the mounting flanges (44) wherein the lift bar assembly (40) is adjustably and removably secured to the bolt plates (50) which have been previously fixedly secured to the roll off container (90).

2. The Adjustable Lift Bar System (30) in claim 1 wherein the rigid, dura ble, and machinable material is selected from the group consisting of steel, steel alloys, stainless steel, and high strength composite materials.

3. The Adjustable Lift Bar System (30) in claim 1 wherein the means for fastening (49) the bolt plate (50) to be fastened to the vertical supports (60) is selected from the group consisting of welding, a threaded bolt, nut and washer, and a removable heavy-duty rivet with washer and heavy cotter pin.

4. The Adjustable Lift Bar System (30) in claim 1 wherein the means for fastening (70) is selected from the group consisting of a minimum of three bolts, nuts, and washers sized approximately 1.00-inch diameter and larger and a minimum of three heavy duty rivets sized approximately 1.00-inch diameter and larger with a cotter pin.

5. The Adjustable Lift Bar System (30) in claim 1 wherein the long spreader tube (46) is selected from a cross section configuration consisting of round, oval, and square.

6. The Adjustable Lift Bar System (30) in claim 1 wherein each of the short spreader tubes (47) is selected from a cross section configuration consisting of round, oval, and square.

7. The Adjustable Lift Bar System (30) in claim 1 wherein the means for fastening (49) is selected from the group consisting of welding, integrally forming and machining.

8. An Adjustable Lift Bar System (30) for a roll off container (90) that is made of rigid, durable, and machinable materials and is comprised of:

(a) a pair of the vertical supports (60) for being fixedly secured to an end surface of the roll off container by a means for fastening (49);

(b) a lift bar assembly (40) including: (1) a lift bar (40A) having a crown (41); (2) a left- and right-handed pair of lift bar flanges (43); (3) a pair of mounting flanges (44) with a set of apertures (44A) to receive a group of removable means for fastening (70), the mounting flanges (44) placed contiguous to each of the pair of vertical supports (60); (4) a long spreader tube (46) placed at a top of the lift bar assembly (40), between the mounting flanges (44), and secured to each flange (44) at each end by a means for fastening (49); (5) a left- and right-hand pair of short spreader tubes (47) whereby each of the pair of short spreader tubes is placed at a bottom of the lift bar assembly (40) between a respective one of the mounting flanges (44) and a respective one of the lift bar flanges (43) and secured at each end to the respective one of the mounting flanges (44) and the respective one of the lift bar flanges (43) by a means for fastening (49);

(c) a left- and right-hand pair of bolt plates (50) each with a series of apertures (52) and each fixedly secured contiguously to the pair of the vertical supports (60) by a means for fastening (49); and (d) the removable means for fastening (70), used to removably fasten each of the pair of the mounting flanges (44) of the lift bar assembly (40) to each of the pair of the bolt plates (50), the removable means for fastening (70) being placed through the apertures (52) of the bolt plate (50) and the apertures (44A) of the mounting flanges (44) wherein the lift bar assembly (40) is adjustably and removably secured to the bolt plates (50) which are configured to have been previously fixedly secured to the roll off container (90).

9. The Adjustable Lift Bar System (30) in claim 8 wherein the rigid, durable, and machinable material is selected from the group consisting of steel, steel alloys, stainless steel, and high strength composite materials.

10. The Adjustable Lift Bar System (30) in claim 8 wherein the means for fastening (49) the bolt plate (50) to be fastened to the vertical supports (60) is selected from the group consisting of welding, a threaded bolt, nut and washer, and a removable heavy-duty rivet with washer and heavy cotter pin.

11. The Adjustable Lift Bar System (30) in claim 8 wherein the means for fastening (70) is selected from the group consisting of a minimum of three bolts, nuts, and washers sized approximately 1.00-inch diameter and larger and a minimum of three heavy duty rivets sized approximately 1.00-inch diameter and larger with a cotter pin.

12. The Adjustable Lift Bar System (30) in claim 8 wherein the long spreader tube (46) is selected from the group consisting of a cross section configuration of round, oval, and square.

13. The Adjustable Lift Bar System (30) in claim 8 wherein each of the short spreader tubes (47) is selected from the group consisting of a cross section configuration of round, oval, and square.

14. The Adjustable Lift Bar System (30) in claim 8 wherein the means for fastening (49) is selected from the group consisting of welding, integrally forming and machining.

15. The Adjustable Lift Bar System (30) in claim 8 wherein the vertical support (60) for being secured to the roll off (90) is selected from the group consisting of a cross section configuration of a square tube, a channel, an "I" beam, an "H" beam, an angle iron and a "tee".

16. A Short Adjustable Lift Bar System (33) for a roll off container (90) with an existing pair of vertical supports (60)

which are rigidly secured to the roll off container, the adjustable lift bar system (33) is made of rigid, durable, and machinable materials and is comprised of:

(a) a left- and right-hand pair of bolt plates (50) each with a series of apertures (52) fixedly welded to a first pair of gusset plates that are in turn configured to be fixedly welded to a top tube structure (95) of the roll off container (90) and an end surface (92) of the roll off container (90) and each of the two left- and right-hand pair of bolt plates further configured to be fixedly welded along a side contiguous to the end surface (92) of the roll off container (90) and further fixedly welded to an end of two sets, an upper set and a lower set, of a left- and right-hand pair of short spreader tubes (47), that end being configured to be closest to a center of the end of a roll off container;

(b) the two sets of a left- and right-hand pair of short spreader tubes (47) whereby the upper set is configured to be placed midway between the top tube structure (95) and the lower set and whereby the lower set has a second pair of gusset plates that are in turn configured to be fixedly welded to the pair of existing vertical structures and an end surface (92) of the roll off container (90) and whereby each set is configured to be fixedly welded at the end opposite with that opposite end being farthest from the center of the end of a roll off container and that opposite end being contiguous and fixedly welded to each of the pair of existing vertical support structures and whereby the lower set is placed; and (c) a lift bar assembly (40) consisting of: (1) a lift bar (40A) having a crown (41); (2) a left- and right-handed pair of lift bar flanges (43); (3) the left- and right-hand pair of mounting flanges (44) with a set of apertures (44A) to receive a group of removable means for fastening (70), the mounting flanges (44) placed contiguous to the left- and right-hand pair of bolt plates (50) each with a series of apertures (52) aligned with the set of apertures (44A) wherein the lift bar assembly (40) is adjustably and removably secured to the bolt plates (50) which are configured to have been previously fixedly secured to the roll off container (90).

17. The Short Adjustable Lift Bar System (33) in claim 16 wherein the rigid, durable, and machinable material is selected from the group consisting of steel, steel alloys, stainless steel, and high strength composite materials.

18. The Short Adjustable Lift Bar System (33) in claim 16 wherein the means for fastening (70) is selected from the group consisting of a minimum of three bolts, nuts, and washers sized approximately 1.00-inch diameter and larger and a minimum of three heavy duty rivets sized approximately 1.00-inch diameter and larger with a cotter pin.

19. The Short Adjustable Lift Bar System (33) in claim 16 wherein each of the short spreader tubes (47) is selected from the group consisting of a cross section configuration of round, oval, and square.

* * * * *